US005944634A

United States Patent [19]

Neves

[11] Patent Number: 5,944,634

[45] Date of Patent: Aug. 31, 1999

[54] ARTIFICIAL HAND-AND FOOTHOLD FOR CLIMBING PRACTICE

[76] Inventor: Eric Neves, HLM Burin des Rosiers, F-43100, Brioude, France

[21] Appl. No.: 08/981,958

[22] PCT Filed: Jul. 9, 1996

[86] PCT No.: PCT/FR96/01067

§ 371 Date: Apr. 2, 1998

§ 102(e) Date: Apr. 2, 1998

[87] PCT Pub. No.: WO97/02870

PCT Pub. Date: Jan. 30, 1997

[30] Foreign Application Priority Data

Jul. 12, 1995 [FR] France ..... 95 08703

[51] Int. Cl.[6] ..... A63B 69/00; A63B 9/00

[52] U.S. Cl. ..... 482/37; 482/35; 482/51; 434/247

[58] Field of Search ..... 482/35, 37, 51, 482/904; 273/441, 444; 434/247; 411/371, 373; 292/251.5; 248/925

[56] References Cited

U.S. PATENT DOCUMENTS

| | | | |
|---|---|---|---|
| 4,136,598 | 1/1979 | Hughes | 411/372 |
| 5,092,587 | 3/1992 | Ulner et al. | 482/37 |
| 5,732,954 | 3/1998 | Strickler et al. | 482/37 |

FOREIGN PATENT DOCUMENTS

| | | | |
|---|---|---|---|
| 2578166 | 9/1986 | France . | |
| 2580183 | 10/1986 | France | 248/925 |
| 2623412 | 5/1989 | France | 482/37 |
| 2628978 | 9/1989 | France | 482/37 |
| 2694703 | 2/1994 | France . | |
| 099478 | 4/1998 | Japan . | |
| 2267651 | 12/1993 | United Kingdom . | |
| 89/09635 | 10/1989 | WIPO . | |

*Primary Examiner*—Richard J. Apley
*Assistant Examiner*—Victor K. Hwang
*Attorney, Agent, or Firm*—Scully, Scott, Murphy & Presser

[57] ABSTRACT

An artificial hand and foothold for climbing practice, comprising a block provided with means for attachment to a wall, and a recess for housing a removable plate with recognition means, such that the plate may be easily but not accidentally removed. The hand and foothold is useful as a teaching medium adding an educational aspect to sporting activities and motivating young students to learn rock climbing, and is suitable for cultural and sporting activities.

5 Claims, 1 Drawing Sheet

ARTIFICIAL HAND-AND FOOTHOLD FOR CLIMBING PRACTICE

BACKGROUND OF THE INVENTION

1. Field of the Invention

The invention concerns the field of physical and sporting activities, and relates to an artificial training hold for climbing, in particular for young children.

Holds of the generic type are known, generally consisting of a block provided with means for fastening to a wall, in particular bolting. At its periphery, the block has indented reliefs to accommodate the fingers, in order to provide a climber with something to grip.

Learning to climb is a popular way for young children to develop their motor co-ordination. More particularly, holds are known in which the block has a familiar configuration, for example that of a car, so that it can be identified with ease by young children.

One problem which needs to be solved resides in the lack of long-term attention which young pupils display for a sustained activity, and in the lack of interest which results when the arrangement of the holds on the wall becomes known and familiar.

2. Discussion of the Prior Art

French Patent FR 2 578 166 discloses an artificial hold, particularly a training hold for climbing, which includes a block of arbitrary configuration, and having an arrangement for fastening to a wall. The block has at least one recess which opens onto one of its faces and is accessible after the block has been fastened to the wall.

SUMMARY OF THE INVENTION

A first object of the invention is to provide an artificial training hold for climbing which makes it possible to capture and hold the attention of young pupils, and further allows the possible routes up a wall to be changed quickly.

A second object of the invention is to provide an artificial hold which, from a basic activity based on climbing, makes it possible to develop other types of training.

According to the invention, an artificial training hold for climbing, comprising a block of arbitrary configuration, provided with means for fastening to a wall and having at least one recess which opens onto one of its faces accessible after the block has been fastened to the wall, is characterized in that a removable plate provided with recognition means is accommodated inside said recess, said plate comprising at least one member forming part of means for removable connection to the block, so that it is easy to remove the plate from the block intentionally, by virtue of said removable connection means, but not accidentally, by virtue of its situation inside the block, which prevents it from being removed accidentally.

The result of these arrangements is, firstly, that a pupil can recognize one hold among many holds fitted to the wall, as he progresses along this wall, and finally that a theme route can be defined beforehand by a teacher, and secondly that the plate is easy to fit in and/or withdraw from the housing, either by the pupil as he progresses, or by the teacher with a view to quickly and easily varying the possible routes along the wall.

The term removable connection is intended to mean a connection which can be broken intentionally and easily, and/or conversely reestablished, and which may be either manual or assisted by mechanical means, so long as the connection is easy to break.

According to a first illustrative embodiment of said removable connection means, these are so-called weak connection means, that is to say they allow the plate to be withdrawn manually by a gentle pull; said weak connection means consist, for example, of means of the magnetic type, or alternatively of the self-fastening strip of interengageable hook-and-loop type; for example, such as is sold under the registered trademark "VELCRO"; that is to say ones which use two complementary supports, attached respectively to the block and to the plate, one having hooks and the other loops, or alternatively of the type involving the interlocking, with slightly tight contact, of the plate inside the housing, it being further possible for said interlocking to involve a clip.

According to another illustrative embodiment of said removable connection means, these are so-called strong connection means, that is to say ones which allow the plate to be removed only when using a tool. For example, said strong connection means consist of a thermoset adhesive, or alternatively are of the type involving screwing. It will be understood that in this case, and without departing from the general rule of the invention, the presence of the housing in the block with the aim of protecting the plate from knocks which may cause it to be removed accidentally, is no longer necessary, although it is still desirable.

It will be understood that the choice between the alternative weak and/or strong connection means depends on the secondary result sought by the user:

Weak connection means are intended to make it possible not only for the plates of a set of blocks fitted to a wall to be interchanged regularly, but also for the plates to be removed by a pupil as he progresses, either for example for him to collect a set of plates whose recognition means have a common theme, such as one color or alternatively one subject, for example a flower or a number, or to temporarily occupy one of the pupil's hands with a view to familiarizing him with such a situation.

Strong connection means are intended to permit regular interchanging of the plates of a set of blocks fitted to a wall, but without allowing them to be removed by pupils.

Preferably, the block has at least one notch at the border of the housing so that this makes it easier to grip and withdraw the plate by virtue of the possibility of sliding a nail and/or a finger into said notch.

According to nonlimiting examples of various embodiments of said recognition means, they are means from the group comprising the color of the plate, an image and/or a symbol reproduced on and/or joined to the plate. In any case, it is desirable for the plate to have a single shape in order to interchange between a large number of plates having respective recognition means.

BRIEF DESCRIPTION OF THE DRAWINGS

The present invention will be understood more clearly and details arising from it will emerge from the following description of preferred embodiments, in connection with the figures of the appended drawings in which.

DETAILED DESCRIPTION OF PREFERRED EMBODIMENTS

Figure 3:
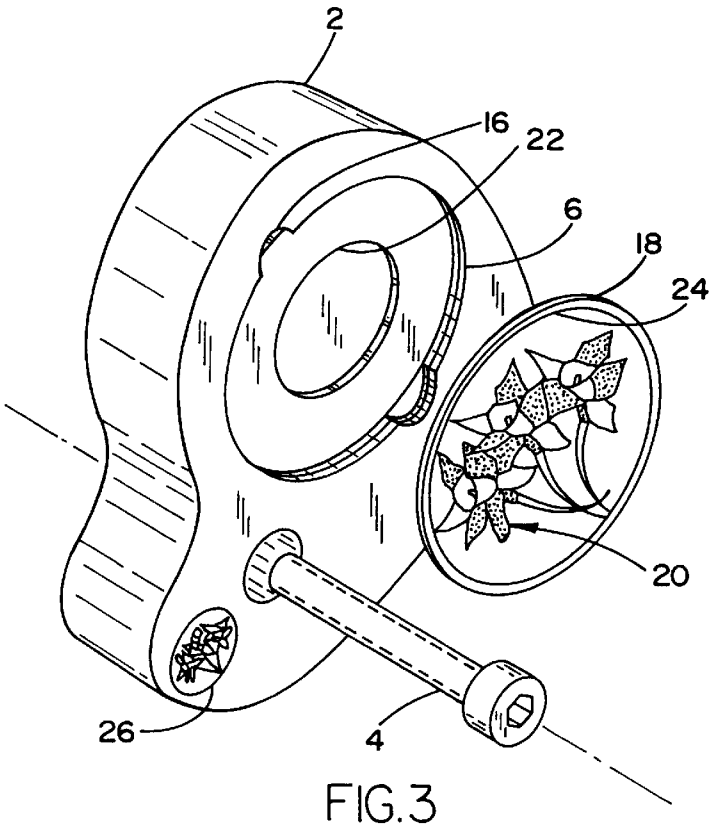
FIG. 3 is an exploded perspective view of an artificial hold according to a second, preferred, embodiment of the invention.

In the figures, an artificial training hold for climbing is of the type comprising a block 2 intended to be attached to a wall, in particular by bolting 4.

The inventive step consisted in providing said block with a removable member for its identification and its recognition, said member including removable connection means allowing it to be withdrawn from the block, and/or conversely to be fitted to the block, intentionally by pupils and/or the teacher, with a view to motivating the pupils and/or using climbing as an educational tool by the association of images in order to teach other disciplines.

According to the illustrative embodiments of the invention which are represented in the figures, a recess (6) is formed in the block in order to accommodate a plate 8, 10, 12 or alternatively 18, on which there is a design 20, for example flowers, as represented in the examples illustrated.

The plates 8, 10, 12 and 18 are removable, so that they can be withdrawn either by a pupil as he progresses over the wall, or with a view to interchanging the images 12 attached to the various holds fitted to a wall and/or adding new images 12 to the holds.

Figure 1:
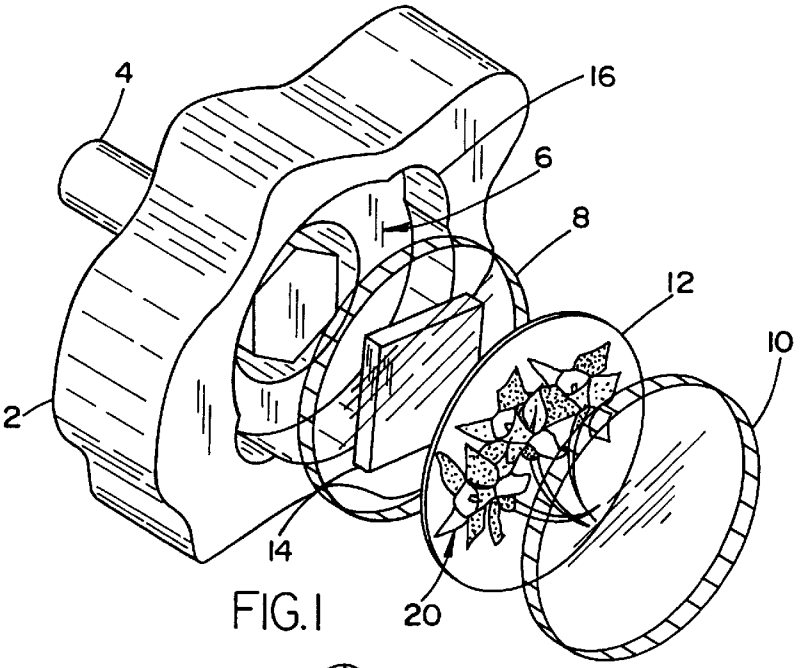
FIG. 1 is an exploded perspective view of an artificial hold according to a first embodiment of the invention.
Figure 2:
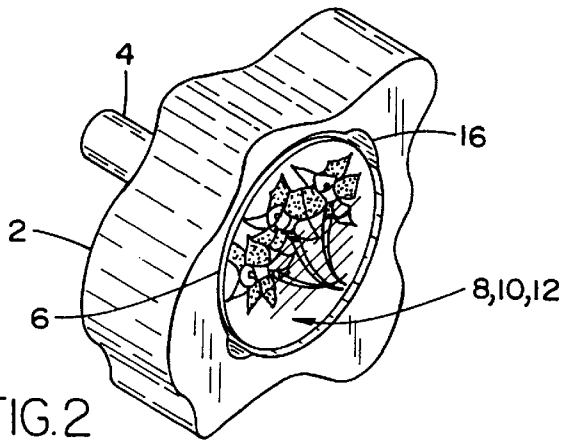
FIG. 2 is a perspective view of the same hold when assembled.

According to the illustrative embodiment of the invention which is represented in FIGS. 1 and 2, the plate consists of two disks 8 and 10, called respectively the rear disk 8 and the front disk 10, which are stacked and fixed to each other. An image 12 forming said recognition means is interposed between the disks 8 and 10, the front disk 10 at least being transparent; according to an advantageous embodiment, the disks 8 and 10 are made of transparent synthetic material, in particular from the polymethacrylate group. As the means for fixing the block 2 to the wall are of the common type involving bolting 4, the means for connecting the plate 8, 10, 12 to the block 2 advantageously consist of a magnet 14 attached to the back face of the rear disk 8, said magnet 14 cooperating with the head of the bolt 4 which fastens the block 2 to the wall.

It will be noted that the recognition means may also be formed not only by other visual recognition means, for example based on a coloration of the plate or alternatively by a design which is affixed, in particular by adhesive bonding, or alternatively by reproduction or by etching an image on the plate, but also by recognition means resorting to other human senses of perception, for example audible means or touch-recognition means.

In the illustrative embodiment illustrated in FIG. 3 it will be noted that the recognition means may consist of a design 20 identifying a specific block 2, the latter incorporating a copy 26 of the same symbol.

In the same illustrative embodiment illustrated in FIG. 3, a climbing hold according to another embodiment of the invention comprises a plate formed by a flexible sheet 18 provided with said recognition means 20 on its face, referred to as the front face, said recognition means 20 being formed by screen printing, as represented in the figure, or alternatively being affixed by means of an adhesive film, and being covered with a coating 24 of transparent protective resin, in particular a polyurethane resin.

In the same figures, the means for connecting the plate to the block advantageously consist of said sheet 18 itself forming part of the plate, the sheet 18 being a magnetic sheet, and of a metal panel 22 held in the bottom of the recess 6, by adhesive bonding or by force-fitting into the latter 6, for example.

It will be noted that, by virtue of these latter arrangements, the position where the recess 6 opens onto the front face of the block can be arbitrary, since it no longer depends on the position of the means 4 for fastening the block 2 to the wall, in contrast to the hold illustrated in FIGS. 1 and 2.

The desired presence of a pair of notches, such as 16, which make it easier to grip and remove the plate 8, 10, 12, will lastly be noted throughout the figures.

I claim:

1. An artificial training hold for climbing comprising a block having an arbitrary configuration, a structure for fastening said block to a wall, said block having at least one recess which opens onto a face on said block which is accessible after the block has been fastened to the wall, a removable plate which is provided with identifying insignia being accommodated within said recess, said plate constituting at least one member forming a part of an arrangement for a detachable connection to the block so as to facilitate intended removal of the plate from the block through said detachable connection means while inhibiting accidental detaching due to a protective positioning thereof within said block, said block having at least one notch formed in a border of the recess to facilitate gripping and withdrawing the plate by engaging into said at least one notch.

2. Climbing hold according to claim 1, wherein the arrangement for detachably connecting the plate to the block is selected from the group consisting of magnetic devices, self-fastening strips, interlocking fasteners and hot-melt adhesives.

3. Climbing hold according to claim 1, wherein said identifying insignia are selected from the group consisting of a coloring of the plate, an image and a symbol reproduced on the plate, and a symbol joined to the plate.

4. Climbing hold according to claim 1, wherein the plate is formed by a magnetic sheet which is equipped with said identifying insignia, said insignia being covered with a coating constituted of transparent protective resin.

5. Climbing hold according to claim 4, wherein the arrangement for the detachable connection of the plate to the block comprises a combination of said magnetic sheet forming the plate, and a metal panel which is retained in a bottom portion of the recess in said block.

* * * * *